US007766772B2

(12) United States Patent
Morrow et al.

(10) Patent No.: US 7,766,772 B2
(45) **Date of Patent: *Aug. 3, 2010**

(54) LACROSSE HANDLE

(75) Inventors: David Morrow, Metamora, MI (US); Andrew Maliszewski, Dearborn Heights, MI (US)

(73) Assignee: Warrior Sports, Inc., Warren, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/642,879

(22) Filed: Aug. 18, 2003

(65) Prior Publication Data

US 2004/0121864 A1 Jun. 24, 2004

Related U.S. Application Data

(60) Provisional application No. 60/403,922, filed on Aug. 16, 2002, provisional application No. 60/415,190, filed on Oct. 1, 2002.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 514, 528, 543, 505; D21/724; 72/208
See application file for complete search history.

(56) References Cited

U.S. PATENT DOCUMENTS

| | | | | |
|---|---|---|---|---|
| D5,178 | S | 8/1871 | Gould | |
| 185,374 | A * | 12/1876 | Whitehouse | 29/527.7 |
| 328,905 | A | 10/1885 | Strasser et al. | |
| D22,250 | S | 2/1893 | Harsha | |
| D22,271 | S | 3/1893 | Ruxton | |
| 1,810,885 | A * | 6/1931 | Neuberth | 72/208 |
| 1,839,919 | A * | 1/1932 | Hall | 72/208 |
| 1,928,009 | A | 9/1933 | Dornier | |
| 1,963,057 | A * | 6/1934 | Wilcox | 29/897.33 |
| 2,237,969 | A | 4/1941 | Olsen | |
| 3,697,069 | A * | 10/1972 | Merola | 473/566 |
| 3,702,702 | A * | 11/1972 | Hoult | 473/513 |
| 3,972,529 | A * | 8/1976 | McNeil | 473/320 |
| 4,037,841 | A | 7/1977 | Lewis, Jr. | |

(Continued)

OTHER PUBLICATIONS

CPSC WebPage, Jun. 1997,web page downloaded May 11, 2005, www.cpsc.gov/cpscpub/prerel/prhtml97/97142.html, 1 page.*

(Continued)

*Primary Examiner*—Gene Kim
*Assistant Examiner*—M Chambers
(74) *Attorney, Agent, or Firm*—Warner Norcross & Judd LLP

(57) ABSTRACT

A handle for a lacrosse head is provided. The handle includes a hollow metal tube having an interior surface and an exterior surface. The hollow metal tube has a first end for communicating with a throat portion of a lacrosse head and a second end opposing the first end. The hollow metal tube has a first thickness defined by a distance between the interior surface and the exterior surface at one location along the hollow metal tube and a second thickness defined by a distance between the interior surface and the exterior thickness at another location along the hollow metal tube. The first thickness has a greater magnitude than the second thickness.

3 Claims, 3 Drawing Sheets

U.S. PATENT DOCUMENTS

| | | | | | |
|---|---|---|---|---|---|
| D245,756 | S | | 9/1977 | McKee | |
| 4,206,918 | A | | 6/1980 | Lewis, Jr. | |
| 4,233,834 | A | * | 11/1980 | Matinlassi | 72/208 |
| 4,280,727 | A | * | 7/1981 | Germain | 294/54.5 |
| 4,445,354 | A | * | 5/1984 | Pfeiffer et al. | 72/208 |
| 4,739,994 | A | * | 4/1988 | Lewis, Jr. | 473/513 |
| 5,048,843 | A | | 9/1991 | Dorfi et al. | |
| 5,568,925 | A | * | 10/1996 | Morrow et al. | 473/513 |
| 5,651,744 | A | | 7/1997 | Millon et al. | |
| 5,749,798 | A | * | 5/1998 | Kuebler et al. | 473/549 |
| 5,951,078 | A | * | 9/1999 | Whitehead et al. | 294/54.5 |
| 6,235,134 | B1 | | 5/2001 | Mueller | |
| 6,500,079 | B1 | * | 12/2002 | Tucker, Sr. | 473/513 |
| 6,752,730 | B1 | * | 6/2004 | Brine et al. | 473/513 |
| 6,889,405 | B2 | | 5/2005 | Ritrovato et al. | |
| 7,404,775 | B2 | * | 7/2008 | Morrow et al. | 473/513 |

OTHER PUBLICATIONS

NPL,webpage download HauteStick, 2000, http://web.archive.org/web/20010224062601/www.hautestick.com/LaxGear/LaxShaft/HyperImpact/SM2-C/HI-SM2C-Info1.htm,9 pages.*
TI22, Lacrosse Handle—Brine.
Ignite, Lacrosse Handle—Brine.
Ignite Supra, Lacrosse Handle—Brine.
Triax, Lacrosse Handle—DeBeer.
STX Lacrosse 2003 Equipment Apparel Catalog, 2 pages.

* cited by examiner

LACROSSE HANDLE

CROSS-REFERENCE TO RELATED APPLICATIONS

The present invention claims priority from U.S. Provisional Application Ser. No. 60/403,922, filed Aug. 16, 2002, and entitled "Lacrosse Stick With Increased Strength" and U.S. Provisional Application Ser. No. 60/415,190, filed Oct. 1, 2002, and entitled "Lacrosse Handle Having Variable Wall Thickness."

TECHNICAL FIELD

The present invention relates generally to a lacrosse handle for attachment to a lacrosse head. More particularly, the present invention relates to a lacrosse handle for attachment to a lacrosse head that has increased strength and resistance to breakage or damage.

BACKGROUND OF THE INVENTION

Original lacrosse handles were constructed of wood. These wood handles were shaped such that the lacrosse handle and the lacrosse head were a single integral wood structure. These wooden lacrosse handles suffered from a variety of disadvantages. Initially, these wooden handles were susceptible to damage from excess exposure to water such as through warping. Further, these prior wooden handles were heavy and somewhat cumbersome and also susceptible to breakage. Moreover, because the wood had to be bent to form the sidewall and the scoop, a significant amount of time was involved in forming or making each of these wooden lacrosse handles, which made them relatively expensive. Because the lacrosse handle and head were a single structure, if any portion of the head or the handle broke or was damaged, the entire wooden handle and head needed to be replaced.

Subsequently, plastic lacrosse heads were developed which were intended to be attached to a lacrosse handle. As the lacrosse heads and the lacrosse handles were separate components that could be manufactured separately, if either the lacrosse handle or the lacrosse head became damaged or broke, each component could be replaced individually. The original handles for attachment to these plastic heads were constructed of wood. These handles were also susceptible to water damage and were relatively heavy and cumbersome.

Thereafter, metal lacrosse handles were developed for attachment to the plastic lacrosse heads. The initial metal handles were less expensive than the prior wood handles. However, they were relatively heavy, which provided disadvantages from both a playability and a safety standpoint. Current lacrosse handles are constructed of a lighter metal, such as aluminum or titanium. These lacrosse handles typically take the form of a hollow metal tube, and are formed by extrusion or similar processes. While having a relatively light weight, the hollow handles are susceptible to breakage or damage. Additionally, these conventional handles also are formed with a uniform wall thickness along the entire length of the tube. In other words, the cross-sectional thickness of the handles from one end to the other end is the same. Moreover, the top and bottom halves of these conventional handles are symmetrical. This is disadvantageous in that the handle does not assist a player in determining the orientation of the handle and thus the attached lacrosse head in the player's hand.

Therefore, a need exists for a lacrosse handle that has increased durability without significantly increasing the weight thereof. A need also exists for a lacrosse handle that provides a player with tactile feedback as to the orientation of the handle in the player's hand.

SUMMARY OF THE INVENTION

It is therefore one advantage of the present invention to provide an improved handle for a lacrosse head that provides tactile stimuli or feedback such that a player can sense the orientation of a lacrosse head attached to the handle without the need for visual inspection.

It is another advantage of the present invention to provide a lacrosse handle having increased strength and durability.

It is a related advantage of the present invention to provide a lacrosse handle for a lacrosse head having increased strength and durability that does not require a significant increase in the weight of the handle.

It is yet another advantage of the present invention to provide a handle for a lacrosse head that yields improved playability and handling.

It is still another object of the present invention to provide a lacrosse handle for attachment to a lacrosse head that has a varying or non-uniform wall thickness.

In accordance with the above and the other advantages of the present invention, a handle for a lacrosse head is provided. The handle is constructed as a hollow tube having an interior surface and an exterior surface. The hollow tube has a first end for communicating with a throat portion of a lacrosse head and a second end opposing the first end. The hollow tube has a first wall thickness defined by a distance between the interior surface and the exterior surface at one location along the hollow tube and a second wall thickness defined by a distance between the interior surface and the exterior thickness at another location along the hollow metal tube. The first wall thickness has a greater magnitude than the second wall thickness.

Other advantages of the present invention will become apparent when viewed in light of the detailed description of the preferred embodiment when taken in conjunction with the attached drawings and appended claims.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION OF THE INVENTION

Figure 1:
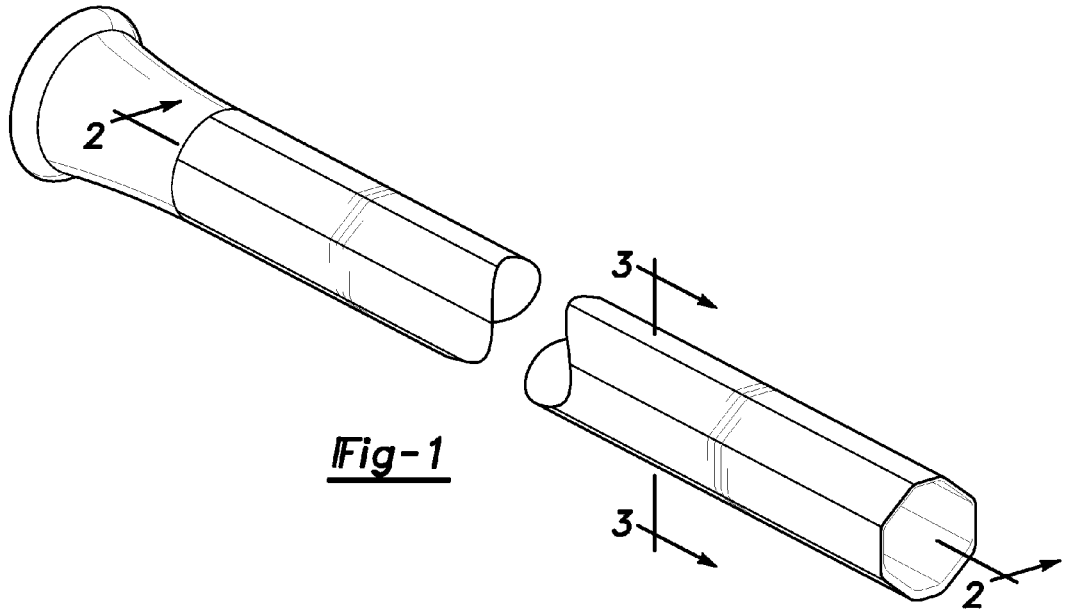
FIG. 1 is a perspective view of a lacrosse handle for attachment to a lacrosse head in accordance with one embodiment of the present invention.
Figure 2:
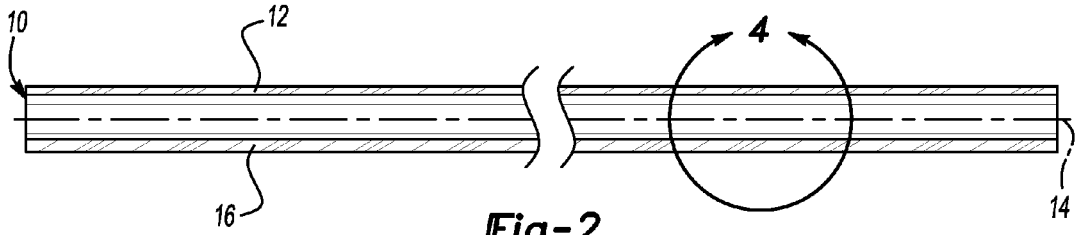
FIG. 2 is a cross-sectional view of the lacrosse handle of FIG. 1 in the direction of the arrows 2-2.
Figure 3:
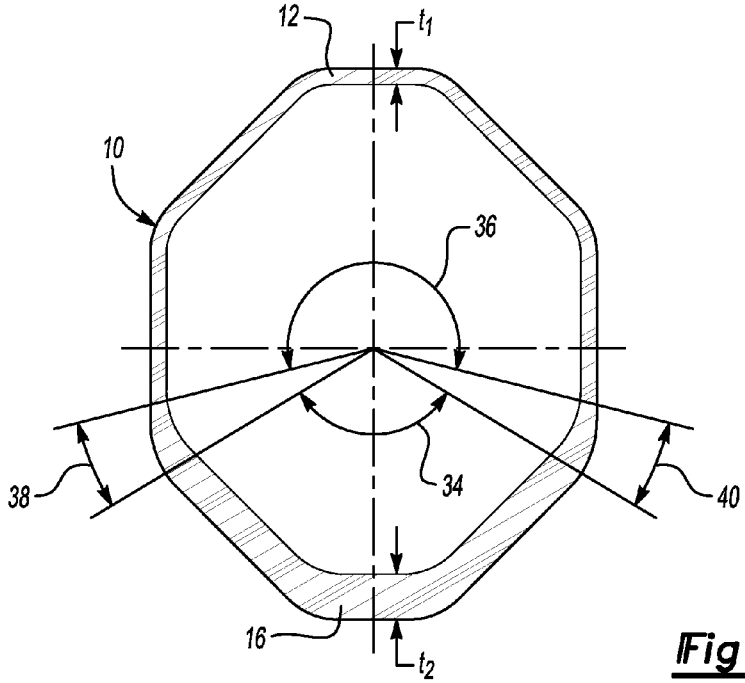
FIG. 3 is a cross-sectional view of the lacrosse handle of FIG. 1 in the direction of the arrows 3-3.

In the following figures, the same reference numerals are used to identify the same components in the various views.

In the embodiment, illustrated in FIGS. 1 through 4, a lacrosse handle having non-uniform wall thickness is shown. The lacrosse handle 10 is preferably an eight sided structure that is generally symmetrically shaped on either side of a handle centerline as is well known in the art. It will be understood, however, that the lacrosse handle can take on a variety of different shapes. The lacrosse handle 10 is preferably constructed of metal, such as aluminum or titanium. However, the handle may be formed of a variety of other materials, such as a variety of alloys. The handle 10 also is preferably constructed as a hollow metal tube with a top portion 12 and a bottom portion 16. The top portion 12 and the bottom portion 16 are generally defined by a centerline 14 of the handle 10.

The top portion 12 has a first wall thickness ($t_1$) and the bottom portion 16 has a second wall thickness ($t_2$). In conventional lacrosse handles, the first wall thickness and the second wall thickness are the same. In fact, in conventional lacrosse handles, the wall thickness is the same along the length of the handle. In accordance with the present invention, the handle 10 has varying wall thicknesses and, in one embodiment, the second wall thickness ($t_2$) is greater than the first wall thickness ($t_1$). In other words, at least a portion of the lacrosse handle 10 has a wall thickness on one side of the centerline 14 that is greater than the wall thickness of another portion of the lacrosse handle 10 on the other side of the centerline 14.

As an illustrative example, the wall thickness ($t_1$) of the top portion 12 is approximately 0.040" while the wall thickness ($t_2$) of the bottom portion 16 is approximately 0.050". It will be understood that that dimensions of the tube wall may vary and dimensions given are merely for purposes of illustration. More preferably, the lacrosse handle 10 is configured such that one half of the handle 10 has a wall thickness that is increased with respect to or greater than the wall thickness of the other half of the handle 10. In one embodiment, the increased wall thickness is generally uniform from one end of the handle to the other end. However, it will be understood by one of ordinary skill in the art that the wall thickness can be different at any two locations along the handle 10.

Figure 4:
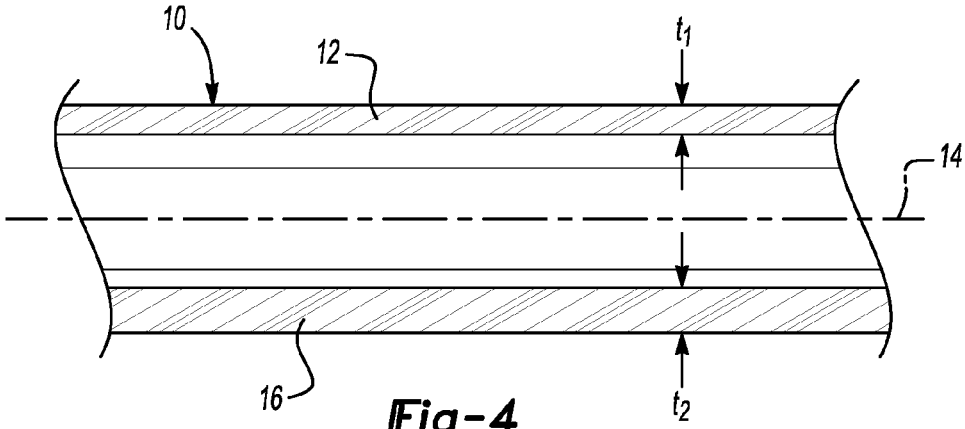
FIG. 4 is an enlarged view the portion of the lacrosse handle of FIG. 2 within the circle labeled 4.

FIG. 4 shows that in the exemplary embodiment of the invention the wall thickness varies about the longitudinal axis of the handle 10 in a plane perpendicular to the longitudinal axis. The wall thickness includes a first range 34 about the longitudinal axis of relatively thicker wall thickness from about the four o'clock position of the cross-section in the clockwise direction to the eight o'clock position, less than one-half around the longitudinal axis and about 120 degrees around the longitudinal axis. The wall thickness is substantially constant about the first range 34. As shown in FIG. 4, the first range 34 of relatively thicker wall thickness is disposed on only one side of the longitudinal axis in the plane perpendicular to the longitudinal axis (the bottom side of the cross-section based on the orientation of FIG. 4). The thickest portion of the handle, the first range 34, is not broken such that portions of relatively thicker wall thickness oppose one another in mirrored relation across the longitudinal axis.

The wall thickness also includes a second range 36 about the longitudinal axis of relatively thinner wall thickness from about the eight-thirty clock position of the cross-section in the clockwise direction to about the three-thirty clock position, over 180 degrees about the longitudinal axis. Thus, the second range 36 extends about the longitudinal axis a greater angle than the first range 34. The wall thickness is substantially constant about the second range 36 around the longitudinal axis of the handle 10. Thus, the wall thickness of the exemplary embodiment is at a minimum over at least 180 degrees about the longitudinal axis.

FIG. 4 also shows that the wall thickness includes two "third" ranges 38, 40 about the longitudinal axis. The third ranges 38, 40 define transition between the relatively thicker wall thickness and the relatively thinner wall thickness. The third range 38 extends about 9 degrees around the longitudinal axis and the third range 40 extends about 17 degrees around the longitudinal axis.

FIG. 4 also shows that the handle 10 is polygonal in cross-section in the plane perpendicular to the longitudinal axis. The exemplary polygon has ten sides and over half of the sides are in the second range 36 and therefore have the relatively thinner wall thickness. The relatively thinner walled sides are disposed adjacent to one another about the longitudinal axis.

This increased wall thickness provides a tactile stimuli or feedback such that a player using the handle 10 can sense in what direction the handle 10 is configured in the player's hand, i.e. whether the portion having an increased wall thickness is facing upward or downward or somewhere in between. Thus, the first range 34 and the second range 36 are operably associated with one another whereby the handle 10 is operable to provide tactile feedback to a user of the handle 10 as to the orientation of the handle 10 in the user's hand. As the lacrosse handle 10 is attached to a lacrosse head, the player can also sense the direction the lacrosse head is facing, based solely on the feel of the weight of the handle in the player's hands. This feature eliminates the need for a player to look at the lacrosse head to determine its orientation during play thereby allowing the player to focus on the game.

While one way of varying the handle thickness to provide tactile stimuli or feedback is disclosed above and shown in FIGS. 1 through 4, it will be appreciated that the lacrosse handle wall thickness can be varied in other ways to provide this tactile feedback. For example, in the half of the lacrosse head 10 where the thickness is increased, the thickness need not extend from one end of the handle to the other. Instead, it need only extend along a portion of the length of the handle. It will be understood that that the increased thickness can extend along any portion of the length of the handle as desired. Alternatively, the increased wall thickness does not need to be uniform from one end of the handle to the other, i.e. the magnitude of the increase may vary. Instead, the half of the handle having the greater wall thickness can have deviations in that thickness along the length of the handle. Moreover, a half weight or other similar structure could be secured within the handle 10 to provide the tactile feedback. It will be understood that the handle 10 can take on a variety of other configurations to allow a player to sense the direction the attached head is facing, including having a side of the lacrosse handle having larger wall thickness than the other side.

Figure 5:
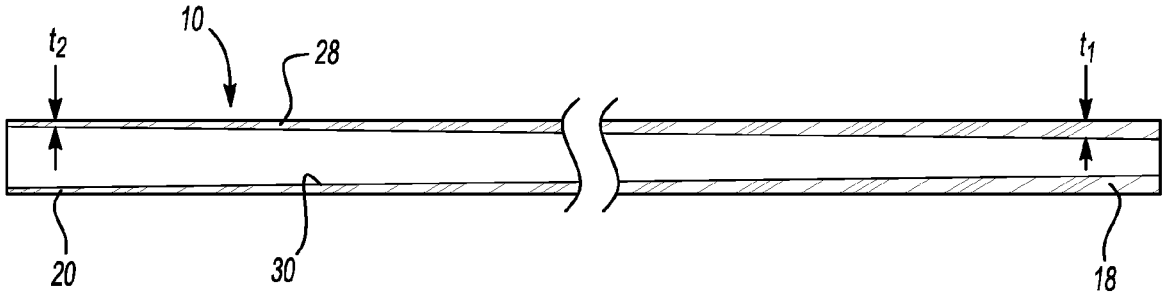
FIG. 5 is a cross-sectional view of a lacrosse handle in accordance with another embodiment of the present invention.
Figure 6:
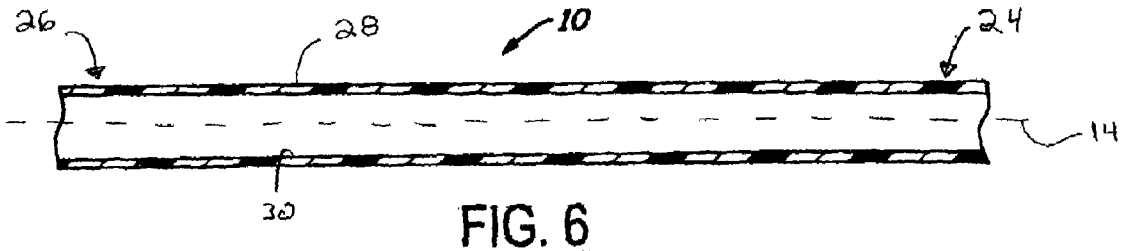
FIG. 6 is an enlarged view of the portion of the lacrosse handle of FIG. 5 within the circle labeled 6.

In another embodiment, shown in FIGS. 5 and 6, the lacrosse handle 10 has a varying wall thickness to provide for increased strength. The handle 10 is preferably comprised of a metal material, however, a variety of other materials may instead be utilized. In this embodiment, the handle 10 is comprised of a hollow tube, which has a first wall thickness ($t_1$) adjacent a first end 18 and a second wall thickness ($t_2$) adjacent a second end 20 with the wall thickness ($t_1$) being larger than the wall thickness ($t_2$). As shown, the wall thickness of the tube wall is gradually tapered such that the hollow interior portion becomes gradually wider as it extends from one end to the other end. As an illustrative example, the tube wall thickness gradually tapers from about 0.050" at the first end 18 to about 0.040" at the second end 20, which attaches to the head. As shown in FIG. 6, the thickness of the tube wall at the portion 24 is larger than the thickness of the tube wall at the portion 26.

It will be understood that he taper may extend in the other direction. It will also be understood that that dimensions of the tube wall may vary and dimensions given are merely for purposes of illustration. Preferably, the dimension of the outside wall of the tube remains the same, i.e. generally parallel to the centerline 14. Put another way, the distance between the exterior surface 28 across the widest part of the handle at the first end 18 is the same as the distance between the exterior surface 28 across the widest part of the handle at the second end 20. However, the distance between the interior surfaces 30 varies from the first end 18 to the second end 20. It will be understood that the taper can be gradual beginning at one end of the handle and tapering along the entire length of the handle. Alternatively, the tapering can begin at the midsection 22 of the handle 10 or at any other location such that it tapers only along a larger or smaller portion of the length of the handle 10.

Preferably, the thinner hollow portion (thickest part of the tube wall) is inserted into the throat of the lacrosse head such that the thicker portion of the tube wall is adjacent the lacrosse head. In this embodiment, the thicker portion would correspond to the first end 18. This taper is intended to provide increased strength to the handle 10 by providing a thicker portion, which results in a lacrosse handle that is stronger and more resistant to breakage. It will be understood that the taper can alternatively be configured such that the thicker portion is adjacent the butt end of the handle. This increased weight at the butt end acts as a counterweight to provide more force as the handle is brought downward during shooting or passing to yield increased ball velocity due to the resulting "whip" action. In yet another embodiment, the lacrosse handle can have increased wall thickness generally in the areas where a player's hands are primarily intended to contact the handle.

Figure 7:
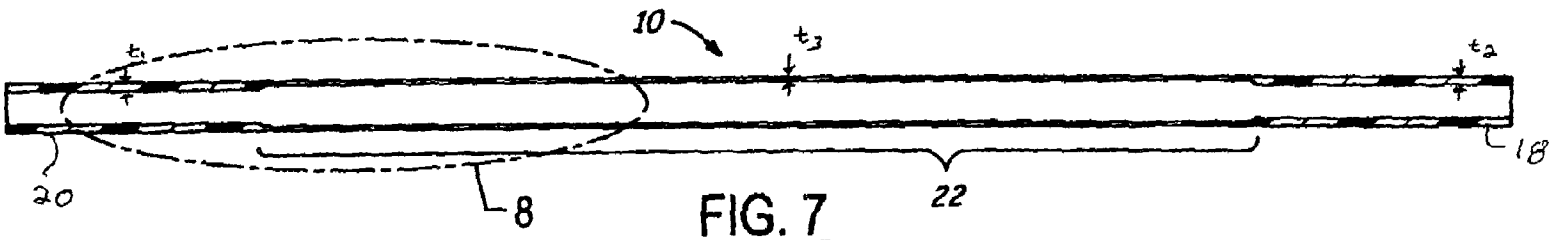
FIG. 7 is a cross-sectional view of a lacrosse handle in accordance with still another embodiment of the present invention.
Figure 8:
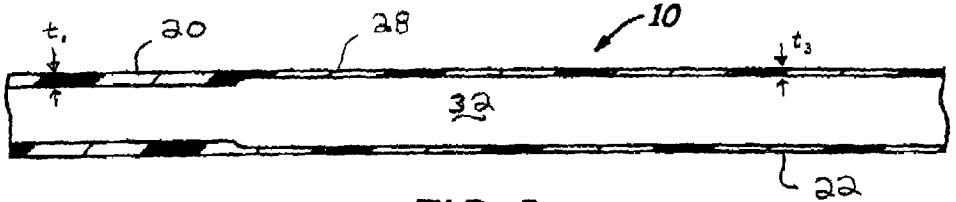
FIG. 8 is an enlarged view of the portion of the lacrosse handle of FIG. 7 within the circle labeled 8.

Referring now to FIGS. 7 and 8, which illustrate another embodiment in accordance with the present invention. In this embodiment, the lacrosse handle 10 has a varying wall thickness to provide for increased strength. The handle 10 is preferably comprised of a metal material, however, a variety of other materials may instead be utilized. As shown, the handle 10 is comprised of a hollow tube, which has a first wall thickness ($t_1$) adjacent a first end 18, a second wall thickness ($t_2$) adjacent a second end 20, and a third wall thickness ($t_3$) adjacent the middle portion 22 of the handle 10. In this embodiment, the wall thickness ($t_1$) and the wall thickness ($t_2$) are generally the same and are both larger than the wall thickness ($t_3$). As shown, the wall thickness of the tube wall is larger adjacent the first end 18 and the second end 20, but is decreased in the middle portion 22 of the handle. Thus, the handle has a wall thickness that is decreased in the middle portion 22 with respect to the end portions 18, 20. It will be understood that the thickness increases in the wall may be located in a variety of different locations. Again, in this embodiment, the dimension of the outside wall 28 of the tube remains the same, i.e. generally parallel to the centerline 14, while the hollow interior portion 32 decreases in size. Put another way, the distance between the exterior surfaces 28 across the widest part of the handle 10 at the first end 18 is the same as the distance between the exterior surfaces 28 across the widest part of the handle at the second end 20. However, the distance between the interior surfaces 32 varies.

While particular embodiments of the invention have been shown and described, numerous variations and alternate embodiments will occur to those skilled in the art. Accordingly, it is intended that the invention be limited only in terms of the appended claims.

What is claimed is:

1. A handle for a lacrosse head comprising:

a hollow tube having a longitudinal length extending along a longitudinal axis between a first end and a second end, said first end adapted to connect to a lacrosse head, said hollow tube including an interior surface and an exterior surface defining a wall thickness therebetween, said exterior surface having an octagonal shape in cross section along a plane normal to said longitudinal axis, said octagonal shape including eight sides and eight corners, wherein the hollow tube includes an outer perimeter that is substantially uniform from the first end to the second end, wherein said hollow tube defines a centerline extending in said plane through said longitudinal axis, the center line dividing the hollow tube into opposing first and second portions wherein the wall thickness of at least one of said sides and said corners in the first portion is greater than the wall thickness of at least one of said sides and said corners in the second portion, such that the difference in wall thickness provides said hollow tube with an asymmetrical weight distribution about said centerline that provides feedback to the user of the lacrosse stick as to the orientation of the hollow tube, and thus the lacrosse head, in the user's hands.

2. The lacrosse handle of claim 1 wherein all of said sides and said corners on said first side of said centerline have a uniform wall thickness that is greater than the wall thickness of all of said sides and said corners on said second side of said centerline.

3. The lacrosse handle of claim 1 wherein at least one of the corners is rounded.

* * * * *